United States Patent [19]

Fleischmann

[11] 4,057,147

[45] Nov. 8, 1977

[54] APPARATUS FOR SUSPENDING GOODS FOR DISPLAY

[75] Inventor: Horst Fleischmann, Munich, Germany

[73] Assignee: PFP-Anstalt Fuer Produkt-Entwicklung und Verwertung, Schaan, Liechtenstein

[21] Appl. No.: 668,814

[22] Filed: Mar. 22, 1976

[30] Foreign Application Priority Data

Mar. 26, 1975 Germany ..... 2513493

[51] Int. Cl.[2] ..... A47F 7/19

[52] U.S. Cl. ..... 211/47; 211/96

[58] Field of Search ..... 211/44, 47, 48, 96, 211/99, 106, 110, 112, 116, 119, 119.12, 119.13, 168, 169, 181, 184, 113

[56] References Cited

U.S. PATENT DOCUMENTS

| | | | |
|---|---|---|---|
| D. 48,178 | 11/1915 | Goldsmith | D6/124 |
| 605,633 | 6/1898 | Deragon | 211/106 X |
| 1,153,677 | 9/1915 | Deragon | 211/96 |
| 1,333,462 | 3/1920 | Brager | 211/96 X |
| 1,652,450 | 12/1927 | Miller | 211/48 |
| 1,879,679 | 9/1932 | Gover | 211/47 X |
| 2,177,084 | 10/1939 | Thomson | 211/96 |
| 2,210,120 | 8/1940 | Gladstone et al. | 211/96 |
| 2,743,023 | 4/1956 | Larson | 211/96 |
| 2,962,169 | 11/1960 | Landsman | 211/119 X |
| 3,817,394 | 6/1974 | Saiki | 211/110 |

FOREIGN PATENT DOCUMENTS

| | | | |
|---|---|---|---|
| 2,357,498 | 5/1975 | Germany. | |
| 2,253,158 | 5/1974 | Germany. | |
| 2,207,521 | 8/1973 | Germany. | |
| 80,372 | 5/1934 | Sweden | 211/96 |
| 78,339 | 3/1930 | Sweden | 211/96 |
| 847,988 | 9/1960 | United Kingdom | 211/119 |

*Primary Examiner*—Roy D. Frazier
*Assistant Examiner*—Thomas J. Holko
*Attorney, Agent, or Firm*—Cushman, Darby & Cushman

[57] ABSTRACT

An apparatus for displaying goods in suspended form includes a fixed carrier support having horizontally and vertically spaced bores, a bearing pin rotatably disposed in each bore and a U-shaped rail bracket extending from said pins with spacer brackets of varying length removably inserted between the legs of said rail bracket.

8 Claims, 13 Drawing Figures

APPARATUS FOR SUSPENDING GOODS FOR DISPLAY

The invention relates to an apparatus for the sorted or spaced display of goods in serial arrangement with rail-like carrier brackets respectively carrying yokes, which are similar to outrigger arms, starting out from rail-like arrangements and on which the yoke holders are attached.

Arrangements for supporting goods have already been proposed (German patent application No. P 23 57 498.6) and they consist of carrying arrangements in the manner of section rails, from which carrier brackets, respectively carrying yokes, extend, which are mounted in the carrying arrangement. At the free ends of the carrier brackets, respectively carrying yokes, a yoke support cam is slid into a part, running parallel, which is equipped on both sides with a button-like projection from which the clothes hanger can be suspended. In case of swiveling the carrier bracket or carrying yokes laterally, these yoke-like supports of several carrying yokes could be hooked together mutually, so that the free swivellability will be hampered. In selling goods it turns out to be particularly advantageous whenever the goods on display are sorted out in a clearly arranged manner.

Since in the sphere of textile goods there are very many articles which are not shown on clothes hangers, it will be desirable to make a supporting arrangement for goods of the type mentioned in such a way that articles of various types can be suspended on the carrier brackets respectively carrying yokes, corresponding to their most effective presentation. At the same time it should be possible to be able always to have several packages of goods or pieces of goods in serial arrangement on one carrying yoke, whereby an attractive presentation will still be assured. Whenever several pieces of goods are suspended from one such carrier bracket, it might, however, happen that the outrigger-like carrier bracket or carrying yoke, which mostly consists of wire, has not enough stability. For this reason, it will also be desirable to provide a bracing on the carrier bracket or carrying yoke, which, however, can also be used functionally for display of the goods.

By a suitable mounting of the carrier brackets or carrying yokes, it is to be guaranteed that they will swing back automatically into their normal position, whenever they have been twisted out of their normal position during inspection of the goods. For this purpose it will likewise be necessary that the carrier bracket or carrying yoke have sufficient stability and is also mounted suitably in the carrying arrangement so that the automatic return will not be impeded either by bending of the carrier brackets, or carrying yokes, nor by an unfavorable bearing stress. This normal position of the swivelable carrier brackets or carrying yokes runs approximately at right angles to the longitudinal direction of the carrier arrangement.

It had already been mentioned that the carrier brackets or carrying yokes are to receive various types of goods in serial arrangement. At the same time these may be, for example, packaged goods or strip-shaped textiles, shoes on special supports, ties, belts, socks, etc., which, however, are to be suspended in the most advantageous way from the carrier bracket or carrying yoke.

This object will be achieved through the invention in an advantageous manner by the carrier brackets or carrying yokes being constructed as carrying or supporting legs running in parallel, and being equipped with bearing and swivelling pins which can be plugged into bearing bores on the carrier arrangement and which are oppositely directed on the ends at the bearing sides, by the fact that spacers can be plugged on, slid on or clamped onto the carrier or supporting legs and by the fact that spacers will limit areas distributed over the length of the carrying or supporting elements, for the sorted suspension of goods. These spacers comprise bridgelike, preferably semi-circularly pulled-in parts, which are joined on both sides by sockets and collets running in the direction of the carrier and supporting legs. These sockets and collets can be of variable or equal length. At the same time provision has also been made that said sockets or collets on one side start in the same plane and end in different planes on the other side. These spacers can be equipped with button-like projections as yoke supports, preferably on both sides of the bridge, the outside surfaces of which are developed as repelling surfaces always in the direction toward the carrier arrangement, which approach each other running in the direction toward the carrier or supporting legs. These repelling surfaces of the yoke support may pass over on the side of the carrier arrangement into a likewise preferably semicircularly pulled in part of the bridge with sockets or collets respectively in the form of border grooves.

At the same time it will be effective to construct the distancer, developed as a yoke support, so that it can be slipped onto the carrier and supporting legs from behind in such a way, that it will be held positively in the forward connecting part of the carrier or supporting legs. Such a spacer, developed as a yoke support, can also be developed in two parts, whereby the two parts are connected with a foil hinge and running along one of the carrier or supporting legs and reaching around the two carrier or supporting legs can be clamped or screwed together.

Such a contrivance, developed according to the invention, for the sorted display of goods offers the possibility that goods can be suspended in serial arrangement along the carrier bracket or carrying yoke as a result of plugging on or clamping on of variable spacers. At the same time, by use of the proper spacers, larger or smaller areas can be defined, whereby for example, in case of delimitation of very small areas along the carrier bracket or carrying yoke a multiplicity of clothes hangers can be hung one behind the other. Whenever larger areas are defined by the spacers, for example, ties or cloths can be put through these areas which are then hanging side by side along the carrying yoke. Such a carrying yoke, according to the invention, will not only become very stable as a result of the spacers, but it also offers the possibility of a very flexible and optimum adaptation to the goods provided in each instance for display.

According to a further development of the invention, provision has been made for the lower carrying and supporting leg to be longer than the upper one, for the bearing and swivelling pins attached at the rear end of the carrying and supporting legs, to be plugged into bearing holes on the carrying arrangement, which holes are mutually displaced in a vertical direction, for the rotational axes of the lower bearing and swivelling pin to be displaced farther back than those of the corresponding bearing and swivelling pin, as a result of which the carrier bracket respectively carrying yoke always returns automatically into the medium lowest swivelling position (rest position) each time in case of a lateral swivelling movement. For such a mounting, a carrying arrangement in the form of a U-rail is advantageous which has staggered bearing bores on opposite legs, whereby the oppositely aligned bearing and swivelling pins point away from one another. Provision has also been made for the carrying apparatus to consist of a square pipe which is provided with the staggered bearing bores on the lower and on the upper surface. The use of two tubes sections running in parallel can also be particularly advantageous whereby the staggered bearing bores are disposed in opposite surfaces. For as perfect as possible a mounting and in order to guarantee a safe mounting of the carrier bracket and carrying yoke in the carrying arrangement, provision has furthermore been made that the bearing and swivelling pins are developed bulged or spherical and the bearing bores cylindrical.

The characteristics and advantages of the invention become clear also from the following description of embodiments in connection with the claims and drawings.

Figure 5:
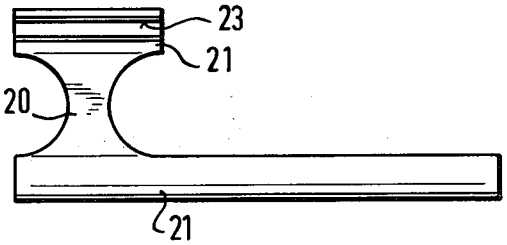
FIG. 5 is a side view of a spacer.
Figure 5A:
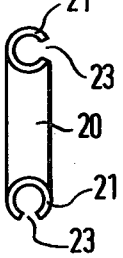
Figure 6:
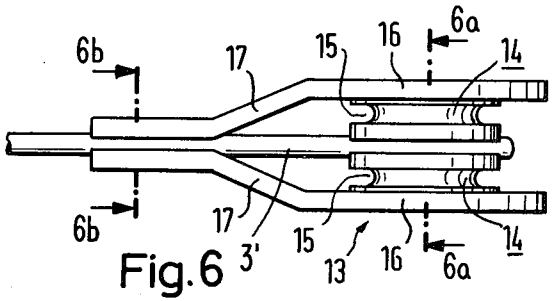
Figure 6A:
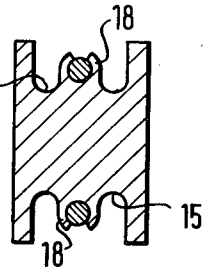
Figure 6B:
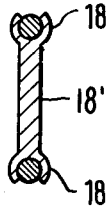
Figure 8:
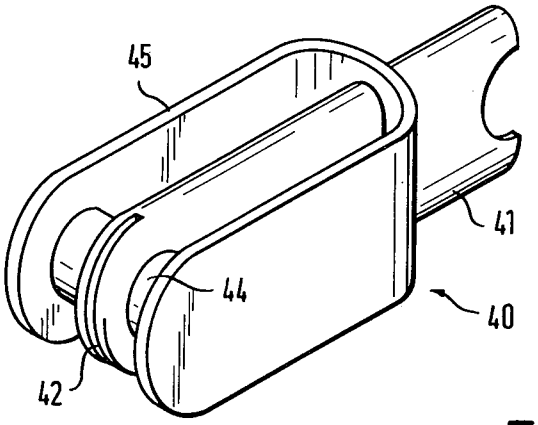
Figure 8A:
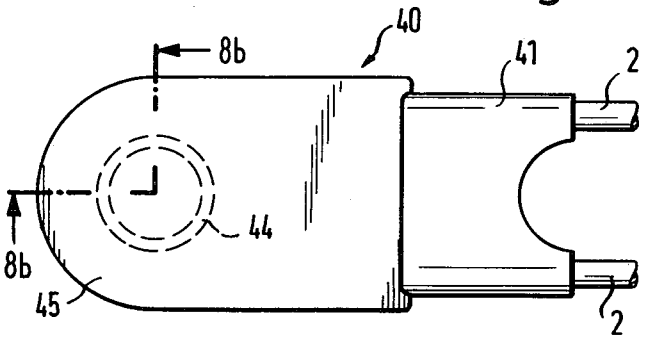
Figure 7:
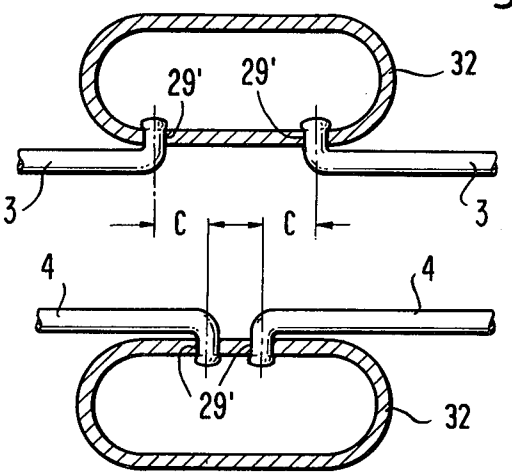
Figure 8B:
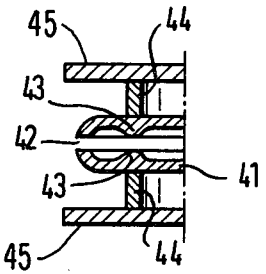

FIG. 5*a* is an end view of the spacer as in FIG. 5;

FIG. 6 is a top view of the yoke support;

FIG. 6*a* shows a cut along line 6A—6A of FIG. 6;

FIG. 6*b* shows a cut along line 6B—6B of FIG. 6;

FIG. 7 shows an additional embodiment of a carrier arrangement made of two tubes sections in which bearing bores are provided, which make possible the attachment of mutually opposite carrier brackets pointing in opposite directions;

FIG. 8 shows another embodiment of a spacer developed as a yoke support, in perspective view;

FIG. 8*a* is a side view of the yoke support as in FIG. 8;

FIG. 8*b* is a cut along line 8B—8B of FIG. 8*a*.

Figure 1:
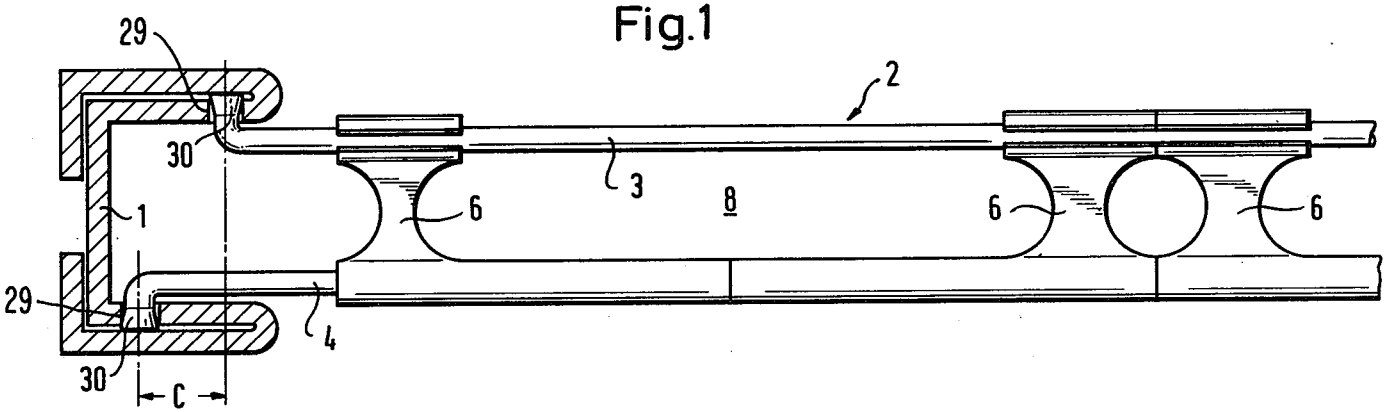
FIG. 1 shows a carrier bracket with pushed on spacers, inserted into a U-shaped carrying arrangement.
Figure 3:
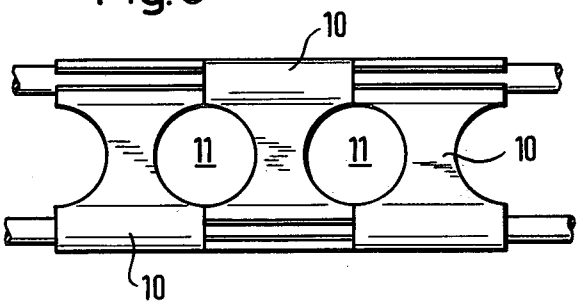
FIG. 3 shows a partial view of a carrier bracket with spacers, which limit hole-like areas for hanging as of clothes hangers.

In FIG. 1 a carrier device 1 is shown in the form of a horizontally extending U-rail from which a carrier bracket 2 made up of an upper supporting leg 3 and a lower supporting leg 4 is mounted to extend horizontally. This carrier bracket consists of a wire material, which is bent such that the two supporting legs run parallel to one another. Spacers 6 are pushed onto the carrier bracket, which will be explained in more detail subsequently. These spacers are unsymmetric in design, so that either longer or shorter areas for hanging up of goods are delimited, depending on the direction in which they are applied to the carrier bracket. In FIG. 1, a longer area 8 is shown, whereas in FIG. 2 a shorter area 9 is recognizable, which develops merely by a different application of the spacers. In FIG. 3 a partial view of a carrier bracket is shown, in case of which symmetric spacers 10 are used, which are provided for the delimitation of perforated areas 11 in which clothes hangers can be suspended, hanging obliquely in relation to the carrier bracket.

Figure 4:
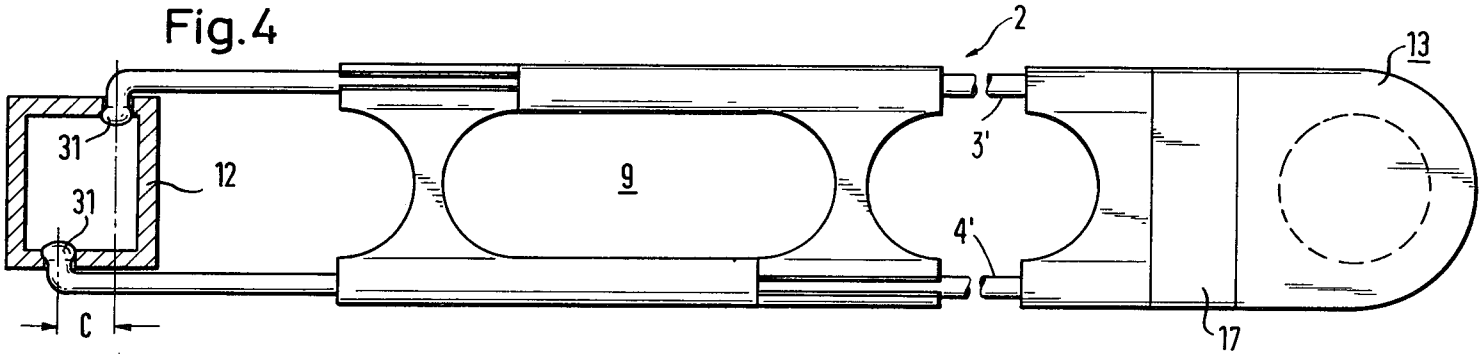
FIG. 4 shows a carrier bracket, which is mounted on a square pipe as a carrying device and which carries at its front end a spacer developed as a yoke support.

In FIG. 4 a carrier bracket 2 is shown, which is mounted in a square pipe as a carrying device 12. The carrier bracket carries a yoke support 13 at its front end in which clothes hangers can be hung, hanging parallel to the carrier bracket. This yoke support is shown in top view in FIG. 6 and comprises button-like projections 14, attached at both sides of the bridge, which are provided with grooves 15 for suspension of the clothes hangers. The outside surfaces 16 of the button-like (knob-like) projections extend in the direction of the carrier device and approach the two supporting legs 3' and 4' of the carrier bracket. In the area of the end of the yoke support 13, pointing toward the carrier device 12, an additional bridge 18' has been provided, the outside surfaces 16 passing over into it. The yoke support 13 can be pushed on from the rear end of the carrier bracket and it comprises the supporting legs with collets 18, which can be clearly seen in FIGS. 6*a* and 6*b*. These FIGS. 6*a* and 6*b* show the yoke support in cut, namely in the area of the knob-like projections and of the rear end.

FIG. 5 and FIG. 5*a* illustrate an unsymmetric spacer, which consists of a bridge 20, joined on both sides by sockets 21. The bridge consists of a part, pulled-in on both sides semicircularly, which passes over into the sockets 21. These sockets are of different lengths, whereby, however, they start on one side in the same plane and end on the other side in different planes (FIG. 5). As becomes clear from FIG. 5*a*, the sockets are slotted in longitudinal direction, whereby the opening or slot 23 is shifted in the lower socket or collet by 90° as compared to the slot 23 in the upper socket or collet. As a result of this arrangement of the slots 23, the spacer can be pushed with the lower socket 21 onto the supporting leg 4 of the carrying yoke and can be engaged by lateral swivelling with the upper supporting leg 3.

From the foregoing, it will be apparent that a spacer may be made in two parts with one edge joined by a hinge which may be a resilient plastic or metal foil. In assembling such a spacer, two parts can be clamped together or screwed together to facilitate assembly of the arrangement.

Figure 2:
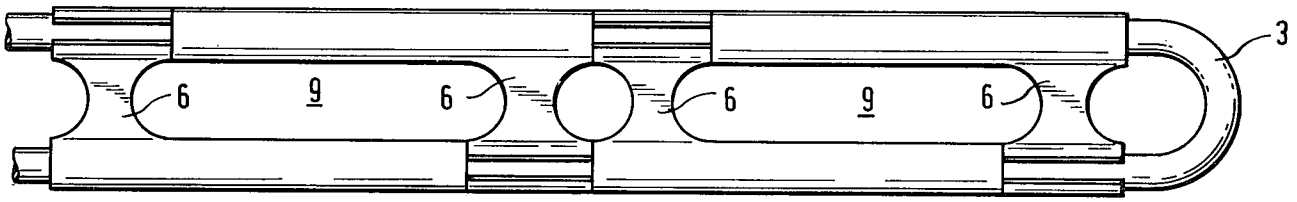
FIG. 2 shows a partial view of a carrier bracket with spacers which define smaller areas for suspension.

This construction of the spacers as in FIG. 5, offers the advantage that, depending on the kind of arrangement, as becomes clear from FIGS. 1 and 2, variably sized areas 8 and 9 can be delimited for the sorted hanging of goods by simply mounting a spacer 6 in a inverted fashion or in the same manner as its adjacent spacer.

Whenever the extended part of the socket or collet is cut off on the underside of the spacer as in FIG. 5, a symmetric spacer can be fashioned, such as used in FIG. 3. It is obvious that the length of the longer socket or collet can be determined arbitrarily in regard to its length, in order to produce areas of suspension of corresponding size.

FIG. 1 illustrates a U-shaped wire arrangement, in case of which the bearing bores 29 run perpendicularly, but are shifted in horizontal direction by the distance C. Correspondingly the lower and upper supporting legs of the carrier bracket 2 terminate in different planes, which are shifted by the distance C. The bearing and swivelling pins 30 on the end of the supporting legs, in case of the embodiment as in FIG. 1, are oppositely aligned and point away from each other. In case of the embodiment as in FIG. 4, the bearing and swivelling pins 31 are likewise aligned oppositely, but they point against each other, so that the carrier bracket can be inserted into a square column or pipe, in case of which the bearing bores, shifted by the distance C are attached on the upper side and the underside of the square pipe.

With the provision of the offset rotational axes of the two bearing pins for each carrier bracket 2, when the supporting legs extend horizontally from the carrier device 1, and the carrier bracket is swivelled laterally from a central position, the carrier bracket will always return under the influence of gravity to its central or middle lowest position.

FIG. 7 illustrates another embodiment of a carrier arrangement, which consists of two sectionally oblong shaped bars or pipes 32. The bearing bores 29' are placed in the opposing surfaces of the profile pipes, whereby the bearing bores in the upper pipe are disposed at a greater distance than in the lower pipe. The difference of the distance amounts to 2 C. In this way carrier bracket legs 3 and 4 can be inserted into the carrier device from both sides, so that the goods are hung and displayed on both sides of the carrying bars 32.

For the construction of the bearings, the bearing and swivelling pins 30 and 31 have been developed slightly spherical or cone-shaped and the bearing bores 29 and 29' consist of cylindrical apertures, which can possibly be slightly enlarged on the side opposite the supporting legs, so that the plugged in bearing or swivelling pins have a safe hold and a good guidance.

FIG. 8 illustrates a spacer, developed as a yoke support 40 which can be pushed onto the carrier bracket 2 from in front. This yoke support 40 consists of a shell-shaped part 41, adapted to the design of the front part of the wire bracket 2, which part on its front side is provided with a slot 42. On the inside of the part 41 and parallel to the inside edge of the bent carrier bracket 2 there runs an elevation 43 which becomes apparent in FIG. 8*b*, and which upon pushing on of the yoke support slips away over the carrier bracket 2 and engages behind that. The slot 42 causes an elasticity in this part of the yoke support, so that the latter can be pushed without hindrance onto the carrier bracket 2. Pipe like bridges 44 run on both sides of the shell-like part 41 to the outside, which pass over at their outside end into a U-shaped bent repelling strip 45. This U-shaped repelling or baffle strip 45 is penetrated by the shell-shaped part 41 in the area of the yoke and it will prevent the yoke supports from hooking into one another upon lateral swivelling of the carrier brackets. The clothes hanger that is to be hung onto the yoke support is hung over the bridge 44, so that always the clothes hangers can be hung on every yoke support.

What is claimed is:

1. Apparatus for the spaced display of goods in suspended serial arrangement comprising:

carrier bracket means including at least two supporting legs extending parallel to one another from a support member, each of said supporting legs having at one end thereof a bearing pin, said support member having at least two bores, each said bearing pin being rotatably disposed in a said bore, spacer members removably disposed on said supporting legs, said spacer members having surface areas from which goods to be displayed can be suspended in spaced relationship over the length of said supporting legs, each said spacer member comprising a bridging portion having along one side thereof a socket for engaging one of said supporting legs and at the other side thereof a socket for engaging the other of said supporting legs, one of said sockets being of predetermined length and the other of said sockets being of a different length, said sockets each having one end lying in a common plane and the other end of one of said sockets lying in a plane that is spaced a perpendicular distance from said first mentioned plane, said bridging portion of each said spacer member including two oppositely facing, semi-circular surfaces extending between said sockets and a said socket on one side of said bridging portion having an opening facing in a predetermined direction with respect to said bridging portion and said socket on the opposite side of said bridging portion having an opening facing in a direction that is 90° from said predetermined direction.

2. The apparatus as claimed in claim 1 wherein said bores in said support member have their rotational axes displaced a perpendicular distance from each other and said supporting legs are of different length corresponding to said perpendicular distance between said rotational axes of said bearing pins, so that, when said longer leg is disposed vertically below the shorter of said supporting legs, and said supporting legs are pivoted in a horizontal plane, said carrier bracket means will always return to a central rest position.

3. The apparatus as claimed in claim 1 wherein said bearing pins have spherical surfaces and said bores are cylindrically shaped.

4. Apparatus for the spaced display of goods in suspended serial arrangement comprising:

carrier bracket means including at least two supporting legs extending parallel to one another from a support member, each of said supporting legs having at one end thereof a bearing pin, said support member having at least two bores, each said bearing pin being rotatably disposed in a said bore, spacer members removably disposed on said supporting legs, said spacer members having surface areas from which goods to be displayed can be suspended in spaced relationship over the length of said supporting legs, said spacer members each comprising a bridging portion having along one side thereof a socket for engaging one of said supporting legs and at the other side thereof a socket for engaging the other of said supporting legs, one of said spacer members including a pair of exterior wall portions which at one end of said one spacer member are formed integrally to extend between said supporting legs and which diverge outwardly from said supporting legs at a point intermediate said ends of said one spacer member and which are joined together adjacent said other end of said one spacer member by projections which extend toward one another from the inside of each of said wall portions.

5. The apparatus as claimed in claim 4 wherein said wall portions at said first mentioned end of said one spacer member have edges which are shaped in the form of sockets for attachment to said supporting legs.

6. The apparatus as claimed in claim 5 wherein said projections of said one spacer member have opposite surfaces shaped in the form of sockets to engage said supporting legs.

7. The apparatus as claimed in claim 4 wherein said spacer member is formed in two parts connected along one side by a hinge and means are provided for securing said two parts together to mount said spacer member on said supporting legs.

8. Apparatus for the spaced display of goods in suspended serial arrangement comprising:

carrier bracket means including at least two supporting legs extending parallel to one another from a support member, each of said supporting legs having at one thereof a bearing pin, said support member having at least two bores, each said bearing pin being rotatably disposed in a said bore, spacer members removably disposed on said supporting legs, said spacer members having surface areas from which goods to be displayed can be suspended in spaced relationship over the length of said supporting legs, one of said spacer members having an exterior U-shaped baffle surface having parallel legs and a connecting portion between said parallel legs and a yoke support member extending between said parallel legs and through said connecting portion of said baffle, said portion of said yoke support which extends through said connecting portion of said baffle being hollow and with the opposite end of said yoke support being connected by bridges to said parallel legs of said baffle.

* * * * *